US006546568B1

(12) United States Patent
Schuster

(10) Patent No.: US 6,546,568 B1
(45) Date of Patent: Apr. 15, 2003

(54) TOILET TANK WITH SEDIMENT REMOVAL ASSEMBLY

(76) Inventor: Michael J. Schuster, 612 Nicholson St., Joliet, IL (US) 60435

( * ) Notice: Subject to any disclaimer, the term of this patent is extended or adjusted under 35 U.S.C. 154(b) by 0 days.

(21) Appl. No.: 09/969,320

(22) Filed: Oct. 1, 2001

Related U.S. Application Data

(63) Continuation of application No. 09/634,249, filed on Aug. 8, 2000, now Pat. No. 6,295,660.

(51) Int. Cl.[7] ..... E03D 1/00
(52) U.S. Cl. ..... 4/353; 122/383
(58) Field of Search ..... 4/321, 323, 353, 4/366, 367, 490, 508; 122/383; 137/432, 436, 437, 438, 441, 444; 134/104.1

(56) References Cited

U.S. PATENT DOCUMENTS

| | | | | | |
|---|---|---|---|---|---|
| 994,727 | A | * | 6/1911 | Dwyer et al. | 122/383 |
| 996,743 | A | * | 7/1911 | Yancey | 137/436 |
| 1,113,057 | A | | 10/1914 | Schuman | 4/262 |
| 2,465,866 | A | * | 3/1949 | Gaines | 4/353 X |
| 2,736,037 | A | | 2/1956 | Hardie | 4/354 |
| 2,799,865 | A | * | 7/1957 | Dufault | 4/366 |
| 3,321,972 | A | | 5/1967 | Goldtrap | 4/353 |
| 3,762,395 | A | | 10/1973 | Taylor | 126/850 |
| 4,134,164 | A | | 1/1979 | Sanmartin Rial | 4/53 |
| 4,505,231 | A | | 3/1985 | Syler | 122/159 |
| 4,527,295 | A | | 7/1985 | Lacore | 4/321 |
| 4,898,124 | A | | 2/1990 | Granberg et al. | 122/381 |
| 5,794,279 | A | | 8/1998 | Schwartz | 4/415 |
| 5,862,537 | A | | 1/1999 | Osmond | 4/363 |
| 6,295,660 | B1 | * | 10/2001 | Schuster | 4/353 |

* cited by examiner

*Primary Examiner*—Robert M. Fetsuga
(74) *Attorney, Agent, or Firm*—Michael J. D'Aurelio

(57) ABSTRACT

A toilet tank with a sediment removal assembly comprises a flexible tube connected to the upper discharge spout of the intake standpipe in the toilet tank cavity, and a configured length of copper tubing connected to the flexible tube for water to flow therethrough when the float valve is open to flow water into the tank during a flushing operation. The copper tubing has a longitudinal section which extends downwardly and vertically from its connection to the flexible tube, an integrally joined first lateral or horizontal section curved or bent to lie on the bottom wall of the tank adjacent to the rear wall, and an integrally joined second lateral or horizontal section curved or bent to extend substantially normal to the first lateral section and lie on the bottom wall of the tank adjacent to the then facing end wall of the tank.

14 Claims, 4 Drawing Sheets

TOILET TANK WITH SEDIMENT REMOVAL ASSEMBLY

CROSS REFERENCE TO RELATED APPLICATIONS

The present patent application is a continuation of and claims the benefit of U.S. patent application entitled "Toilet Tank with Sediment Removal Assembly" filed on Aug. 8, 2000, assigned Ser. No. 09/634,249, and issued on Oct. 2, 2001 as U.S. Pat. No. 6,295,660 B1."

FIELD OF THE INVENTION

This invention relates to the field of toilet tanks and apparatus or methods to solve the problem of removing the sediment which accumulates therein. It relates particularly to a sediment removal assembly which cleans the tank out and removes the sediment during the operation of flushing the toilet.

BACKGROUND OF THE INVENTION

The only relevant prior art of which the inventor is aware consists of the following United States patents which were found in a search of the files in the United States Patent and Trademark Office, where complete details of each patent are readily available:

- U.S. Pat. No. 5,862,537 for a Flush Lever Operated Reservoir Toilet Tank Control.
- U.S. Pat. No. 5,794,279 for a Water Saver Attachment for Toilets.
- U.S. Pat. No. 4,898,124 for a Scale Agitator.
- U.S. Pat. No. 4,505,231 for a Water Heater Construction With Sediment Removal Means.
- U.S. Pat. No. 3,762,395 for a Device For Preventing. Sediment Build-Up In Gas Water Heaters.
- U.S. Pat. No. 2,736,037 for an Automatic Valve Apparatus.
- U.S. Pat. No. 1,113,057 for a Cuspidor

SUMMARY OF THE INVENTION

The toilet tank with sediment removal assembly in accordance with this invention comprises a configured tubular assembly connected at its upper end to an additional outlet water spout provided at the upper end of the intake standpipe, adjacent the conventional outlet spout which flows water through a tube to the toilet bowl. This additional spout with the tubular assembly connected thereto, flows water into and through the tubular assembly during the flushing operation of the toilet. At such time, water in the tank is also being ejected through the outlet ports provided around the periphery of an annular discharge member at the bottom of the tank into the toilet bowl in accordance with this invention, to create a current flow across the surface of the bottom wall of the tank that begins to lift and carry any sediment on the bottom of the tank. Thus, while water is beginning to flow upward through the standpipe into the tank to refill the tank to its proper level, water is also being emitted through the discharge ports around the lower portion of the standpipe. A float valve assembly opens to admit water into the standpipe and tank when the float drops with the water level as water drains out from the tank during the toilet flushing operation.

The configured tubular assembly has a vertically extending section which reaches down to lie on the bottom of the tank where it curves or bends into an elongated horizontal section that lies adjacent to the inside lower edge of the rear side wall of the tank. That elongated section then bends or curves as it approaches the facing end wall of the tank into a shorter horizontal section that lies adjacent to the inside lower edge of that end wall, and that extends in a direction toward the opposite side wall of the tank where the tubular assembly terminates in an open free end.

During the flushing operation when water flows into and through the configured tubular assembly, water is flowed in a rapid stream out from the open free end in the direction toward the opposite side wall of the tank at its intersecting corner with the end wall. This rapid flow of water along a portion of the end wall and impact of such stream with the opposite side wall starts to direct the stream in a swirling circular manner. This agitates the water at the bottom of the tank, and in conjunction with the jets of water being emitted from the discharge ports around the annular member at the lower end of the standpipe, raises the sediment from the bottom whereby it begins to be carried by the swirling stream of water as it rotates and swirls toward the drain in the bottom of the tank through which the water is being flowed from the tank to the toilet bowl during the flushing operation.

To add to the swirling circular motion, one or both of the horizontal sections of the tubular assembly are provided with a plurality of small spaced apart ports or apertures opening in the direction away from the tank walls each lies adjacent to and toward the respective opposite side and end walls. Thus, as water flows through the tubular assembly, a portion of the water is forced out through the plurality of small ports and directed across the bottom wall of the tank to further agitate and dislodge sediment on the bottom. The combined operation of the jet of water emitted from the open free end of the tubular assembly hitting the opposite side wall at the corner of the adjacent end wall to begin the swirling circular motion of the water, plus the jets of water being emitted through the small ports of the tubular sections lying along the bottom edge of one side wall and one end wall, plus the jets of water being forced through the discharge ports of the annular member at the lower end of the standpipe, create a turbulent, swirling and circular current or stream of water sufficient to dislodge sediment from the bottom of the tank and carry it to the drain outlet where it is sucked out along with the larger stream of water which is being flowed from the tank into the toilet bowl during the flushing operation.

DESCRIPTION OF PREFERRED EMBODIMENT

Figure 1:
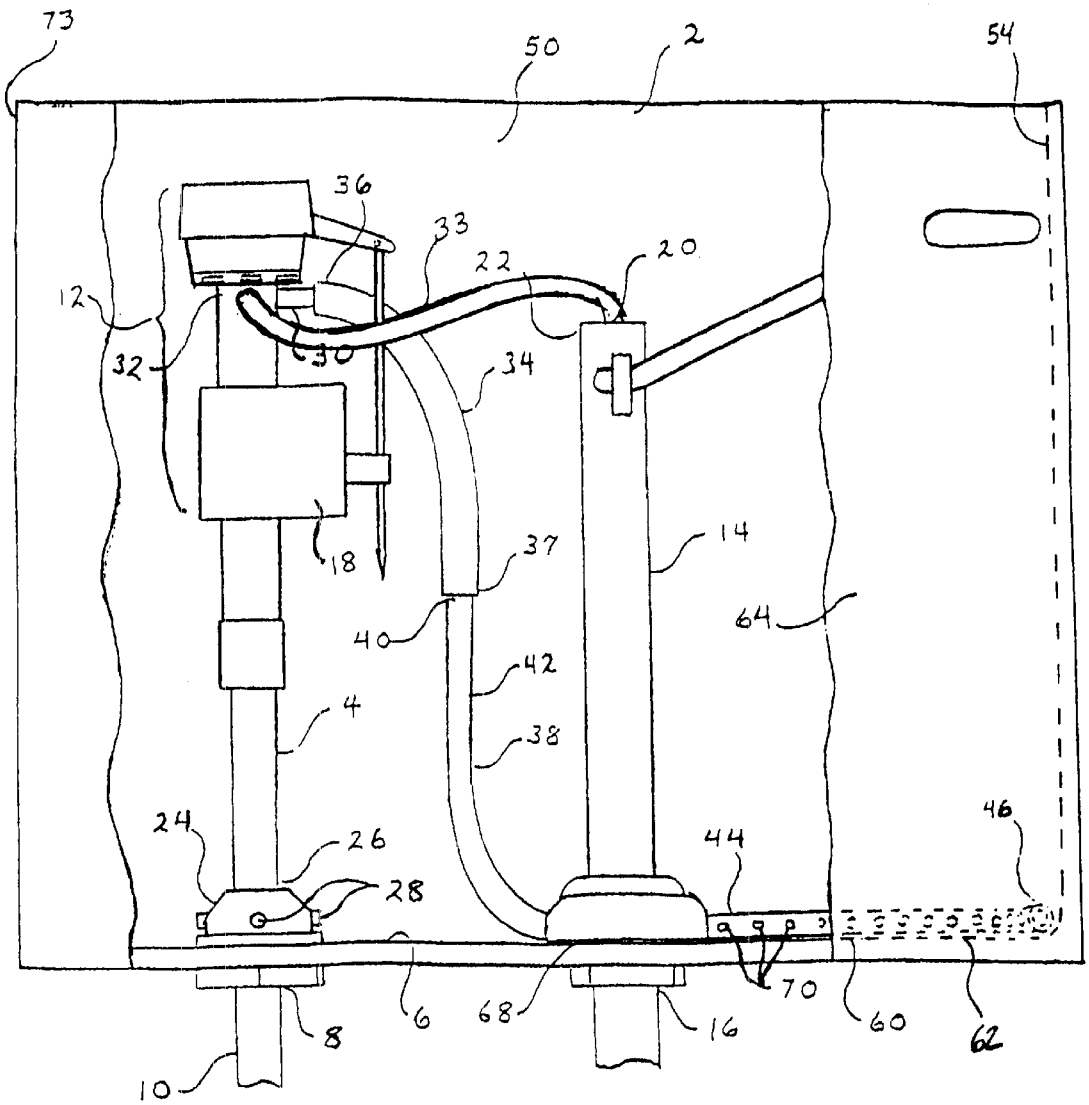
FIG. 1 is an elevation view of a toilet tank with the front wall partially broken away to show the sediment removal assembly in accordance with this invention.
Figure 2:
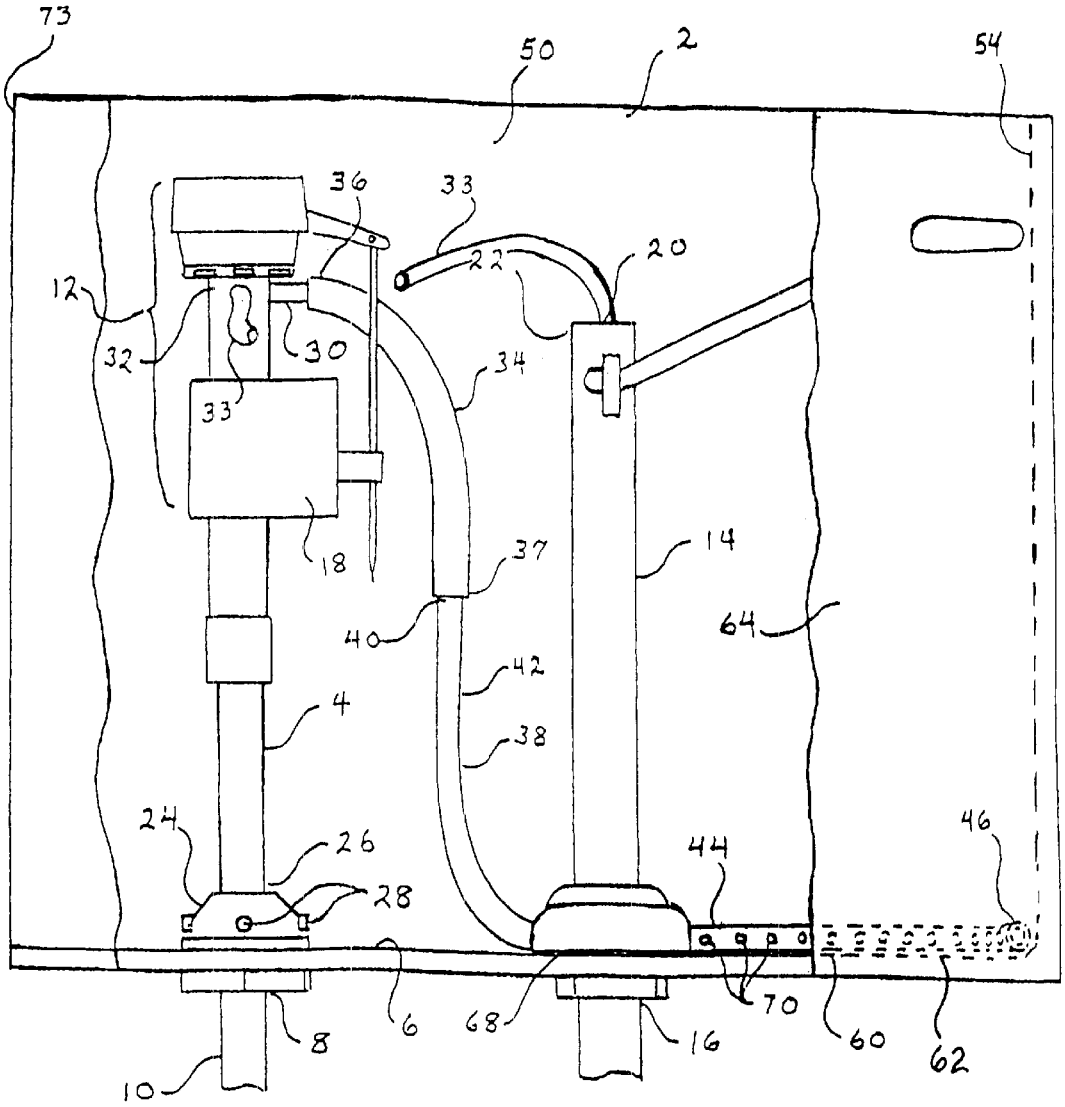
FIG. 2 is an elevation view of the toilet tank as seen in FIG. 1 with the discharge tube connected to the conventional water spout at the upper end of the standpipe partially broken away to more clearly show the tubular assembly connected to the additional discharge spout of this invention at the upper end of the standpipe adjacent to and radially spaced apart from the conventional water spout.
Figure 3:
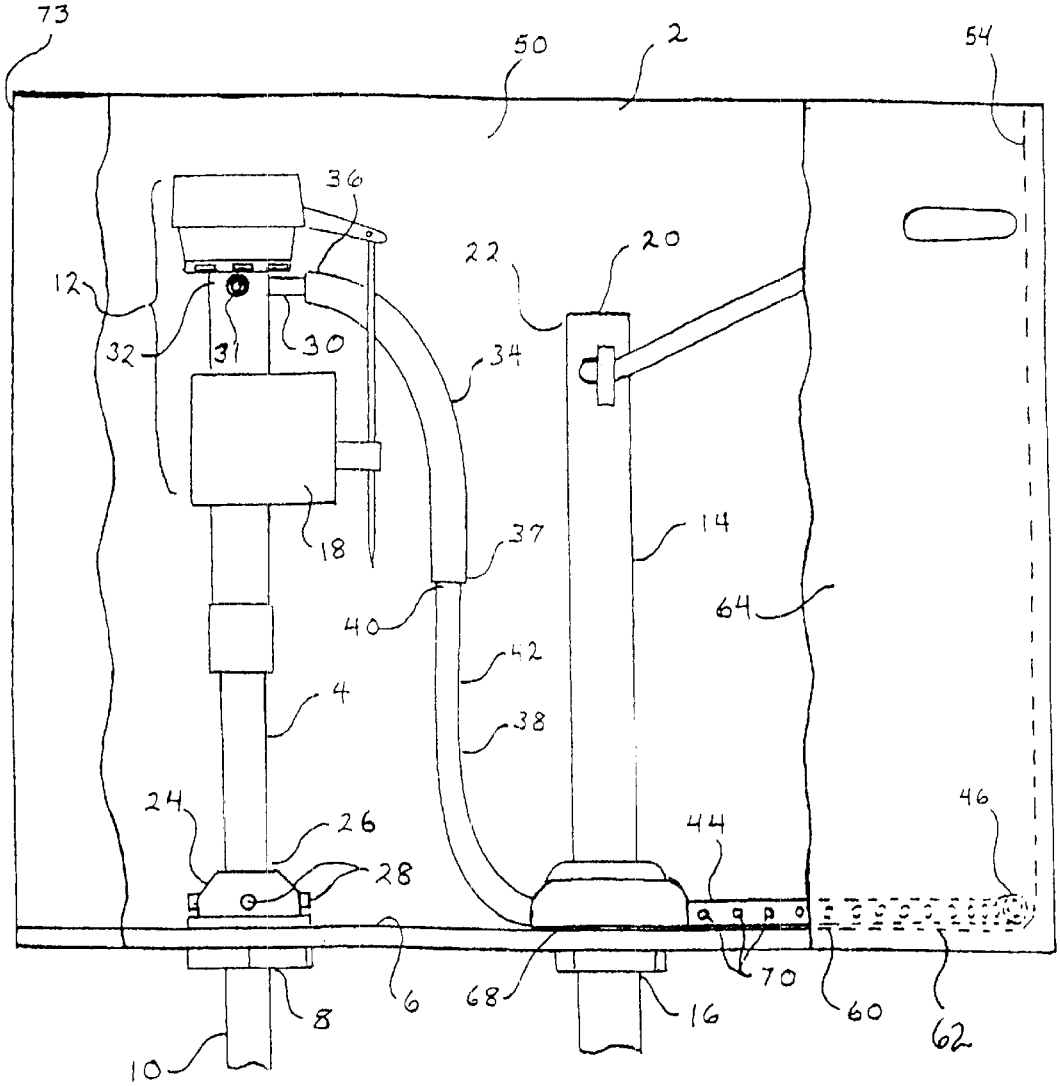
FIG. 3 is an elevation view of the toilet tank as seen in FIGS. 1 and 2, with the discharge tube normally connected to the conventional discharge spout removed to show the conventional discharge spout itself.
Figure 4:
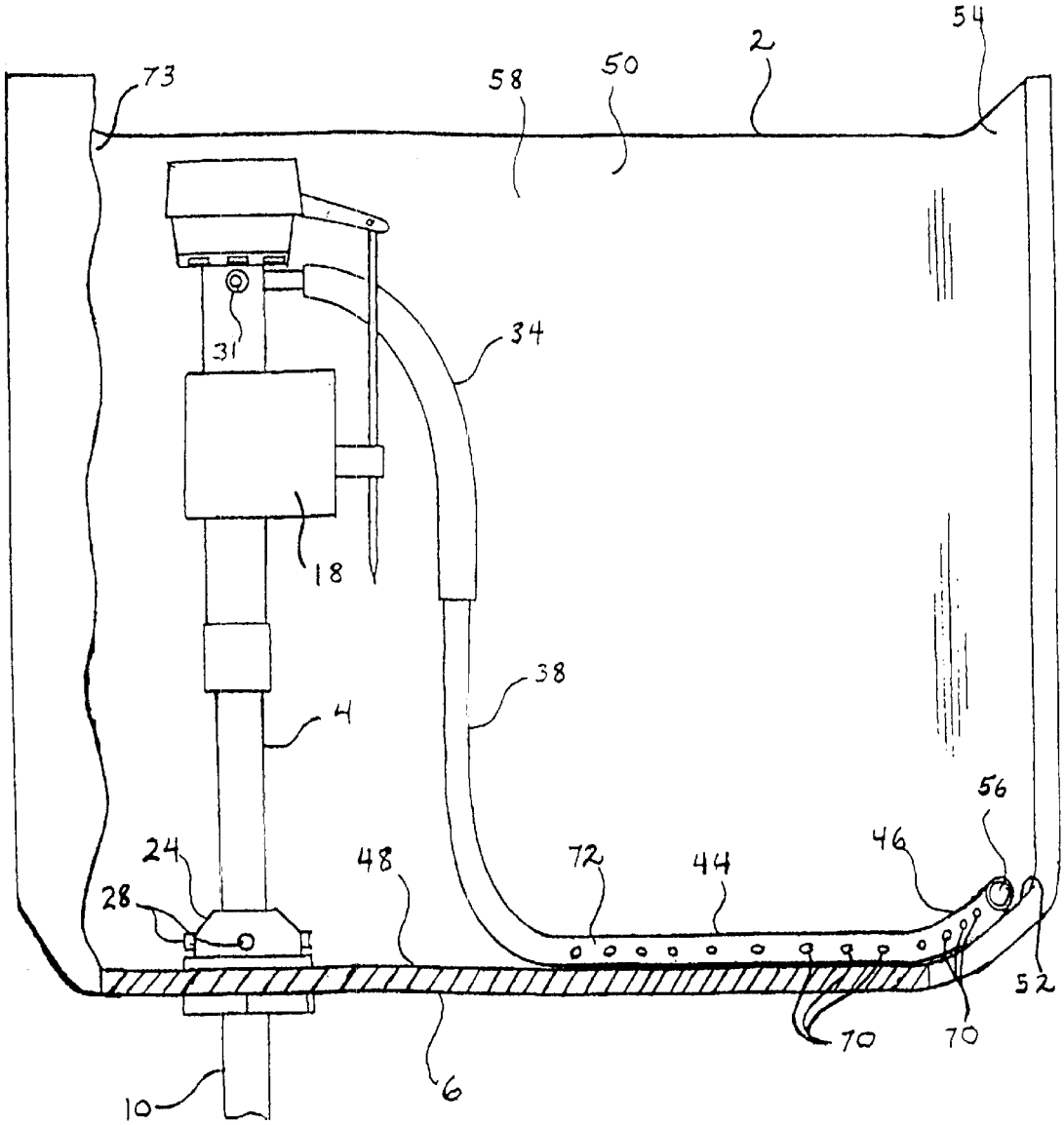
FIG. 4 is a perspective view taken from the interior of the toilet tank shown in FIG. 1 with a center portion of the bottom wall shown in section taken on a line behind the overflow pipe seen in FIG. 1, to more clearly show the entire flexible tubing and the integrally formed copper tubing sections that would otherwise be partially concealed; a portion of the front wall of the tank is shown broken away toward the left.

A toilet tank assembly with sediment removal assembly in accordance with this invention comprises a storage tank 2 having a standpipe 4 extending upright from the bottom wall 6 of the tank 2, with a connecting portion 8 extending through the bottom wall 6. A supply conduit 10 is connected to the connecting portion 8 of the standpipe below the bottom wall 6 of the tank. The supply conduit 10 leads to a pressurized water supply. A float valve assembly 12 is connected to the standpipe 4 to admit water into the storage tank 2 when in the valve open position and to prevent flow of water through the standpipe and into the tank 2 when in the valve closed position.

An overflow pipe 14 also extends upwardly from the bottom wall 6 of the storage tank, having a portion 16 which extends through the bottom wall for connection to a drain outlet. The float 18 of the float valve assembly rises with the water level as water is flowing through the standpipe 4 into the tank 2 until the tank is filled to the selected level, shortly below the level of the inlet port 20 opening to the upper end 22 of the overflow pipe 14. When that water level is reached, the float 18 has risen to the level at which it moves the valve stem and closure member of the valve assembly 12 to the valve closed position, whereupon flow of water into the storage tank is discontinued.

An annular member 24 in accordance with this invention is provided around the lower end 26 of the standpipe 4, having four radially spaced apart outlet ports 28 to discharge water in laterally directed streams or jets from the interior passageway of the standpipe as water is flowed therethrough when the storage tank 2 is being filled. A laterally extending discharge spout 30 in accordance with this invention is provided at the upper end region 32 of the standpipe 4 through which water is also discharged in a lateral stream when water is flowing into and through the standpipe 4. The discharge spout 30 is adjacent to and radially spaced apart from the conventional discharge spout 31 to which one end of the tube 33 is connected, the other end positioned to discharge water into the, pipe 14 from which the water flows into the toilet bowl during the flushing operation to refill the bowl after the flushed water has been drained out.

In addition to the annular member 24 and and the outlet jets or ports 28, the sediment removal assembly in accordance with this invention also includes a flexible tube 34 or flexible conduit connected at one end 36 to the discharge spout 30. The flexible tube 34 hangs downward from the spout 30 and is connected at its lower end 37 to a copper tube 38. The flexible tube 34 in accordance with a preferred embodiment of the invention is about eight inches long. The copper tube 38 has an upper end 40 which is connected to the lower end 37 of the flexible tube 34. The copper tube 38 has a longitudinal section 42 which hangs downwardly from the flexible tube 34 about five to six inches, whereupon it curves or bends to extend laterally about nine inches in a first laterally extending section 44. The copper tube 38 then curves or bends to extend laterally in a second laterally extending section 46 which extends in a direction substantially normal to the first laterally extending section 44. The first laterally extending section 44 is about nine to ten inches in length. The second laterally extending section 46 is about three to four inches in length.

All sections of the copper tube 38 are continuously integrally joined as a single unitary tube. The dimensions of each section, and the dimension of the flexible tube 34 may vary depending on the size of the storage tank in which the tube is to be used.

The combined length of the flexible tube 34 and the longitudinal section 42 of the copper tube 38 is sufficient to reach from the discharge spout 30 at the upper end of the standpipe 4 to the bottom wall 6 of the storage tank 2. The first laterally extending section 44 of the copper tube 38 lies on the inner surface of the bottom wall 6, along its side edge 48 and adjacent the lower edge of side wall 50 of the storage tank 2 until it approaches the end edge 52 of the bottom wall 6 and the lower edge of end wall 54 of the storage tank 2. At this point the integrally formed second laterally extending section 46 extends in a direction substantially normal to the first laterally extending section 44, and lies on the inner surface of the bottom wall 6 along the end edge 52 thereof and adjacent the lower edge of the end wall 54 of the storage tank 2.

The free end 56 of the copper tube 38 is open for discharge of water flowing from the discharge spout 30 of standpipe 4 through the flexible tube 34 and copper tube 38 into the cavity 58 of the tank 2. The free end 56 of the copper tube 38 lies along the end edge 52 of the bottom wall 6 near and facing the opposite side edge 60 of the bottom wall and the lower edge 62 of the opposite side wall 64 of the storage tank 2. Thus, water being discharged from the open free end 56 of the copper tube at such location will spew against the lower edge region of the side wall 64 of the storage tank and begin to flow from the corner region of the end wall 54 and the intersecting opposite side wall 64 in a swirling manner along the lower edge of side wall 64 and the opposite side edge 60 of the bottom wall 6 of the storage tank 2. This discharge and swirling flow of water on the inner surface of the bottom wall 6 of the storage tank 2 creates a swirling or circular stream of water that lifts sediment from the bottom wall of the tank and carries the sediment in such circular stream toward the drain outlet 68 in the central portion of the bottom wall 6.

The laterally extending sections 44 and 46 of the copper tube 38 include a plurality of spaced apart small apertures 70 through the tubular wall 72 thereof. The apertures 70 of the first laterally extending section 44 open in the direction away from the first storage tank side wall 50 which the first laterally extending section 44 lies adjacent to, and toward the opposite side wall 64 of the tank 2. The apertures 70 of the second laterally, extending section 46 open in the direction away from the end wall 54 which that section of the copper tube 38 lies adjacent to, and toward the opposite end wall 73 of the storage tank 2.

Thus, as water is discharged from the discharge spout 30 into and through the flexible tube 34 and copper tube 38, a portion of such water is emitted in small jet like streams out through such small apertures 70 at the level of the bottom wall 6 of the tank 2, from side wall 50 toward opposite side wall 64, and from end wall 54 toward opposite end wall 73 of the tank 2. This supplements and reinforces the swirling circular stream of water resulting from the water being spewed from the free end 56 of the copper tube 38 as described above, and the jets of water being ejected through the ports 28 of the annular member 24 at the lower end of the standpipe 4.

Water is discharged from the spout 30 when the toilet is flushed which empties the water in the tank 2 into the toilet bowl, whereupon the float 18 of the float valve assembly drops moving the valve closure member in the standpipe 4 to the valve open position thus admitting water into and through the standpipe into the cavity 58 of the tank 2 to refill. It is during this refill operation that water is discharged through the jets or ports 28 of the annular member 24 across the surface of the bottom wall 6 of the tank 2, through the spout 30, through the flexible tube 34 and the sections of the copper tube 38 to create the swirling circular stream of water around the bottom of the tank 2. Such discharge of water to create such swirling circular stream of water around the bottom of the tank begins while water is still being drained from the tank to complete the flush operation, so that water and the sediment being carried thereby drains out through the drain outlet 68 into the toilet bowl and from there to the conduit leading to the sewer tile.

In accordance with the present invention, each time the toilet is flushed, the sediment removal assembly as shown and described herein provides a swirling circular current or stream of water in the manner of a whirlpool at the bottom of the tank sufficient to lift and carry any sediment from the bottom region of the tank out thereof as part and parcel of the flushing operation.

I claim:

1. A toilet tank with sediment removal assembly comprising:

a water storage tank with a bottom wall;

a water inlet in the water storage tank;

a water drain outlet in the water storage tank; and an sediment removal pipe operatively associated with the water inlet, the sediment removal pipe with at least one discharge opening, the discharge opening being aimed to direct an amount of water along the bottom wall, the discharge opening comprising an open free end laying on the bottom wall, whereby an amount of sediment resting on the bottom wall is raised from the bottom wall and moves out of the water storage tank through the water drain outlet.

2. The toilet tank with sediment removal assembly of claim 1, wherein the at least one discharge opening is aimed away from a first wall of the water storage tank and toward a second wall of the water storage tank, the first wall being located opposite the second wall.

3. The toilet tank with sediment removal assembly of claim 1, wherein the open free end of the sediment removal pipe is aimed along a lower edge of one of a number of walls of the water storage tank, thereby creating a circular water flow in the water storage tank.

4. The toilet tank with sediment removal assembly of claim 3, wherein the one of the number of walls of the water storage tank is an end wall.

5. The toilet tank with sediment removal assembly of claim 4, wherein the open free end of the sediment removal pipe is facing a side edge of the side wall.

6. The toilet tank with sediment removal assembly of claim 1, wherein the open free end of the sediment removal pipe is facing a side edge of a wall of the water storage tank, thereby creating a circular water flow in the water storage tank.

7. The toilet tank with sediment removal assembly of claim 1, further comprising:

an annular member operatively associated with the water inlet; and a number of outlet ports to discharge water in laterally directed streams into the water storage tank.

8. The toilet tank with sediment removal assembly of claim 1, wherein the sediment removal pipe further comprises a number of discharge openings located on a portion of the sediment removal pipe that lies on the bottom wall.

9. A method for removing sediment in a toilet tank, comprising:

providing a water storage tank with a bottom wall, a water inlet, a drain outlet, and a sediment removal pipe operatively associated with the water inlet, the sediment removal pipe having at least one discharge opening, the discharge opening comprising an open free end of the sediment removal pipe;

laying the open free end of the sediment removal pipe on the bottom wall of the water storage tank;

receiving an amount of water into the water storage tank through the water inlet;

aiming the at least one discharge opening along the bottom wall; and raising an amount of sediment along the bottom wall and directing the amount of sediment out of the water storage tank through the drain outlet by discharging the amount of water into the water storage tank through the at least one discharge opening.

10. The method of claim 9, wherein the aiming of the discharge opening along the bottom wall further comprises aiming the at least one discharge opening away from a first wall of the water storage tank and toward a second wall of the water storage tank, the first wall being located opposite the second wall.

11. The method of claim 9, wherein the aiming of the discharge opening along the bottom wall further comprises aiming the at least one discharge opening along a lower edge of one of a number of walls of the water storage tank, thereby creating a circular water flow in the water storage tank.

12. The method of claim 9, wherein the aiming of the discharge opening along the bottom wall further comprises facing the at least one discharge opening toward a side edge wall of the water storage tank, thereby creating a circular water flow in the water storage tank.

13. The method of claim 9, further comprising:

providing an annular member operatively associated with the water inlet, the annular member including at least one outlet port laterally directed into the water storage tank long the bottom wall; and discharging the amount of water through the at least one outlet port along the bottom wall.

14. The method of claim 9, further comprising:

providing a number of discharge openings located on a portion of the sediment removal pipe; and laying the portion of the sediment removal pipe having the discharge openings on the bottom wall.

* * * * *